US005512136A

United States Patent [19]

Altug et al.

[11] Patent Number: 5,512,136

[45] Date of Patent: Apr. 30, 1996

[54] APPARATUS AND METHOD FOR REMOVING PAPER WEB TRIM FROM A FORMING WIRE

[75] Inventors: Mustafa N. Altug, Dalton; Leo J. Robert, Cheshire, both of Mass.

[73] Assignee: James River Paper Company, Inc., Richmond, Va.

[21] Appl. No.: 413,359

[22] Filed: Mar. 30, 1995

[51] Int. Cl.[6] ..... D21F 1/32; D21F 1/30

[52] U.S. Cl. ..... 162/195; 162/198; 162/252; 162/308; 162/275

[58] Field of Search ..... 162/195, 308, 162/198, 252, 309, 310, 239, 353, 334, 275

[56] References Cited

U.S. PATENT DOCUMENTS

| | | | |
|---|---|---|---|
| 2,215,335 | 9/1940 | Parkhill et al. | 162/134 |
| 3,218,227 | 11/1965 | Moore et al. | 162/255 |
| 3,245,872 | 4/1966 | Nelson | 162/255 |
| 3,291,681 | 12/1966 | Wolf | 162/275 |
| 3,839,148 | 10/1974 | Beck | 162/310 |
| 3,898,085 | 11/1976 | Crosby | 162/198 |
| 4,152,202 | 5/1979 | Deligt | 162/198 |
| 4,154,648 | 5/1979 | Osterberg et al. | 162/195 |
| 4,390,433 | 6/1983 | Duncan | 210/767 |
| 4,701,242 | 10/1987 | Scarano et al. | 162/275 |
| 4,897,159 | 1/1990 | Bone et al. | 162/260 |
| 5,020,469 | 6/1991 | Boissevain et al. | 118/67 |
| 5,045,154 | 9/1991 | Baluha | 162/353 |
| 5,234,172 | 8/1993 | Chupka et al. | 241/301 |
| 5,286,348 | 2/1994 | Perin | 162/262 |

*Primary Examiner*—David L. Lacey
*Assistant Examiner*—Jose S. Fortuna
*Attorney, Agent, or Firm*—Thomas R. Lampe

[57] ABSTRACT

A plurality of spaced knock-off shower nozzles are located adjacent to an edge of a paper web forming wire to provide knock-off sprays which will remove trim strips from the wire. A control is provided to separately and independently control the spray nozzles so that the operator can adjust the number of nozzles being sprayed in accordance with the width of the trim strip.

5 Claims, 4 Drawing Sheets

APPARATUS AND METHOD FOR REMOVING PAPER WEB TRIM FROM A FORMING WIRE

TECHNICAL FIELD

This invention relates to the field of paper making and, more particularly, to a system for removing a marginal portion, or trim, from a paper web during manufacture of the paper web.

BACKGROUND ART

Paper making machines employing head boxes not of the variable deckle type always generate trim which proceeds to a couch pit for subsequent recovery and recycling through the machine.

It is known to provide knock-off showers for removing trim from a Fourdrinier wire or other paper web forming fabrics as well as for cleaning the fabric. The width of the trim being removed from the wet paper web varies depending upon a number of factors. However, prior art knock-off showers utilized to remove trim deliver the same amount of water and over the same wire area for such purpose regardless of the width of the trim being removed. This can cause a variety of problems downstream during the recovery process.

In the recovery process, excess water from the couch pit must be removed to raise consistency before the trim can be recirculated through the paper making machine. This problem is aggravated considerably when a relatively narrow strip of trim is being knocked off the forming wire since prior art systems emit water from all of the nozzles thereof regardless of trim width.

A search of the prior art located the following United States patents which are believed representative of the current state of the prior art: U.S. Pat. No. 4,154,648, issued May 15, 1979, U.S. Pat. No. 3,218,227, issued Nov. 16, 1965, U.S. Pat. No. 5,045,154, issued Sep. 3, 1991, U.S. Pat. No. 3,245,872, issued Apr. 12, 1966, U.S. Pat. No. 3,839,148, issued Oct. 1, 1974, U.S. Pat. No. 5,234,172, issued Aug. 10, 1993, U.S. Pat. No. 4,897,159, issued Jan. 30, 1990, U.S. Pat. No. 4,701,242, issued Oct. 20, 1987, and U.S. Pat. No. 4,390,433, issued Jun. 28, 1983.

None of these patents illustrate an arrangement for varying the quantity of water or other liquid applied to remove paper web trim from a forming wire to compensate for different trim widths.

DISCLOSURE OF INVENTION

The present invention relates to an apparatus and a method which effectively, efficiently, and relatively inexpensively adjust the quantity and placement of knock-off liquid sprays employed to remove trim from a forming wire to adjust for different trim widths. With the arrangement of the present invention the amount of knock-off water entering a couch pit for subsequent recovery can be minimized, greatly simplifying the downstream steps employed in the recovery process.

The apparatus of the present invention relates to a structural combination including a paper web forming wire having spaced edges and a forming wire support surface between the spaced edges for supporting a wet paper web during paper web formation, the paper web forming wire movable along a path of movement.

Paper slurry delivery means is provided for delivering a paper slurry to the forming wire support surface of the paper web forming wire.

A plurality of knock-off shower nozzles are located adjacent to the paper web forming wire, the knock-off shower nozzles being spaced from one another and arrayed laterally relative to the path of paper web movement for directing a plurality of liquid knock-off sprays onto the paper web forming wire adjacent to and inwardly of an edge of the paper web forming wire.

The apparatus additionally includes liquid delivery means for delivering a liquid to the plurality of knock-off shower nozzles.

Control means is operatively associated with the liquid delivery means and the plurality of knock-off shower nozzles for selectively and independently controlling the flow of liquid through each knock-off shower nozzle of said plurality of knock-off shower nozzles from the liquid delivery means to vary the location of liquid knock-off sprays directed onto the marginal portion of the paper web forming wire and to vary the total quantity of liquid directed on to the marginal portion of the paper web forming wire by the knock-off shower nozzles.

The invention also includes a method of controlling the flow of knock-off liquid in a paper making machine including a paper web forming wire having spaced edges and a forming wire support surface between the spaced edges for supporting a wet paper web during web formation, the paper web forming wire movable along a path of movement, and paper slurry delivery means for delivering a paper slurry to the forming wire support surface of the paper web forming wire.

The method includes the steps of positioning a plurality of knock-off shower nozzles adjacent to the paper web forming wire with the knock-off shower nozzles being spaced from one another, arrayed laterally relative to the path of movement of the paper web forming wire, and located above a marginal portion of the paper web forming wire adjacent to and inwardly of a forming wire edge of the paper web forming wire.

A source of liquid for said plurality of knock-off shower nozzles is provided.

The method also includes the step of selectively and independently controlling the flow of liquid through each knock-off shower nozzle of said plurality of knock-off shower nozzles from said source of liquid to vary the location of liquid knock-off sprays directed on to the marginal portion of the paper web forming wire from the knock-off shower nozzles and to vary the quantity of liquid directed on to the marginal portion of the paper web forming wire by the knock-off shower nozzles.

Other features, advantages, and objects of the present invention will become apparent with reference to the following description and accompanying drawings.

BEST MODE FOR CARRYING OUT THE INVENTION

Figure 1:
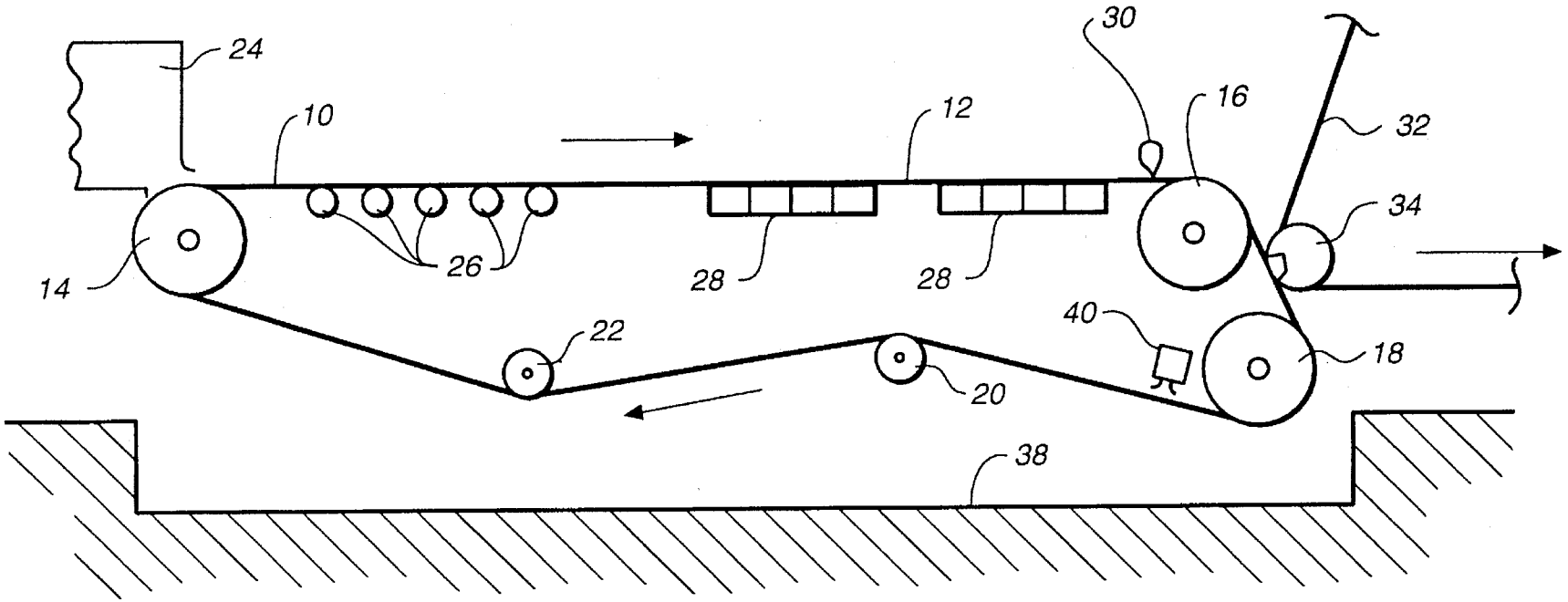
FIG. 1 is a diagrammatic presentation of the forming section of a paper-making machine incorporating the present invention.

Referring now to FIG. 1, a looped Fourdrinier wire 10 having a forming wire support surface 12 is supported by rolls 14, 16, 18, 20 and 22. The wire moves along a path of movement shown by the arrows above and below the wire.

A head box 24 delivers a wet paper slurry to the support surface 12 of wire 10. The deposited slurry travels over table rolls 26 and over suction boxes 28. An air knife 30 is disposed over the wire and wet paper web supported thereby and is utilized to cut trim from the web before the web engages a transfer fabric or felt 32 looped about a vacuum roll 34. A couch pit 38 is disposed under forming wire 12.

The structure just described is conventional and need not be described in detail. The present invention is for the purpose of knocking off or removing the trim from the wire, it being understood that the trim follows the wire past vacuum roll 34 and stays on the wire. Dislodging of the trim from the wire is accomplished by spraying a quantity of water on the wire 12 along a marginal portion of the wire carrying the trim and which is adjacent to and inwardly of an edge of the wire. With the present invention the amount and location of the sprayed water can be varied in accordance with the particular width of the trim. In other words, only water that is actually needed to dislodge the trim need be sprayed onto the wire.

Figure 2:
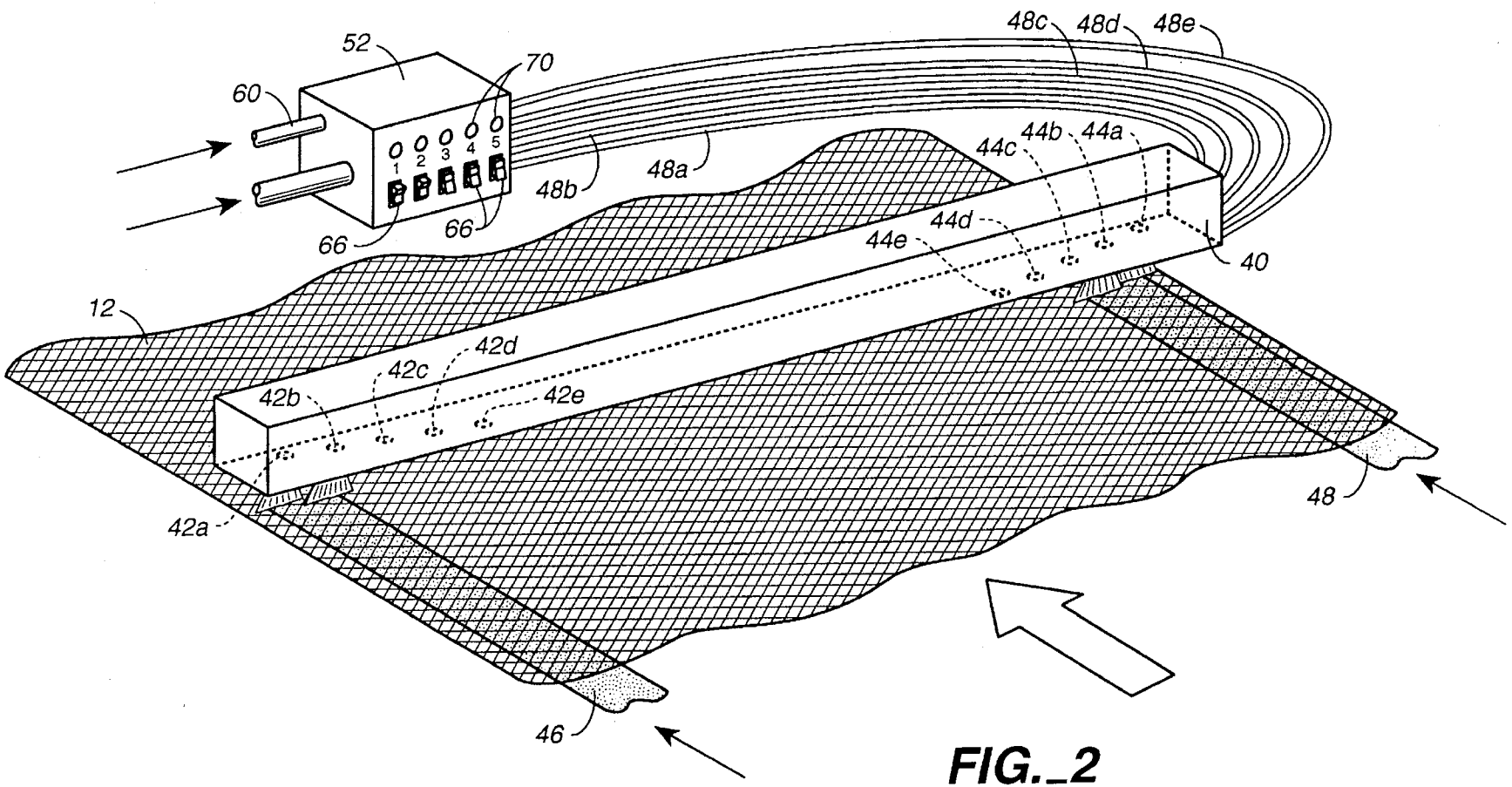
FIG. 2 is a diagrammatic, perspective view of apparatus components constructed in accordance with the teachings of the present invention.
Figure 3:
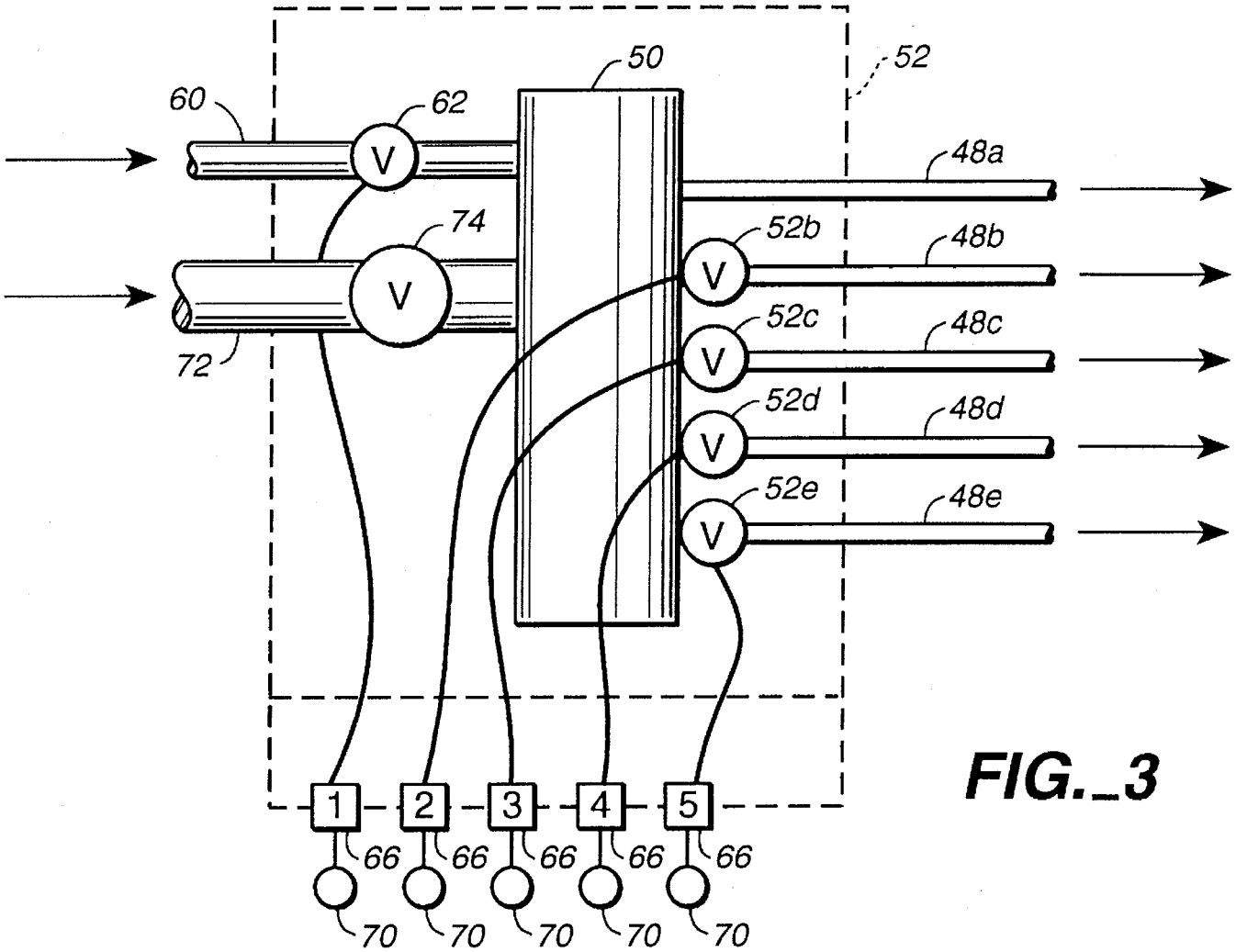
FIG. 3 is a diagrammatic view of selected structural elements of the apparatus.
Figure 4:
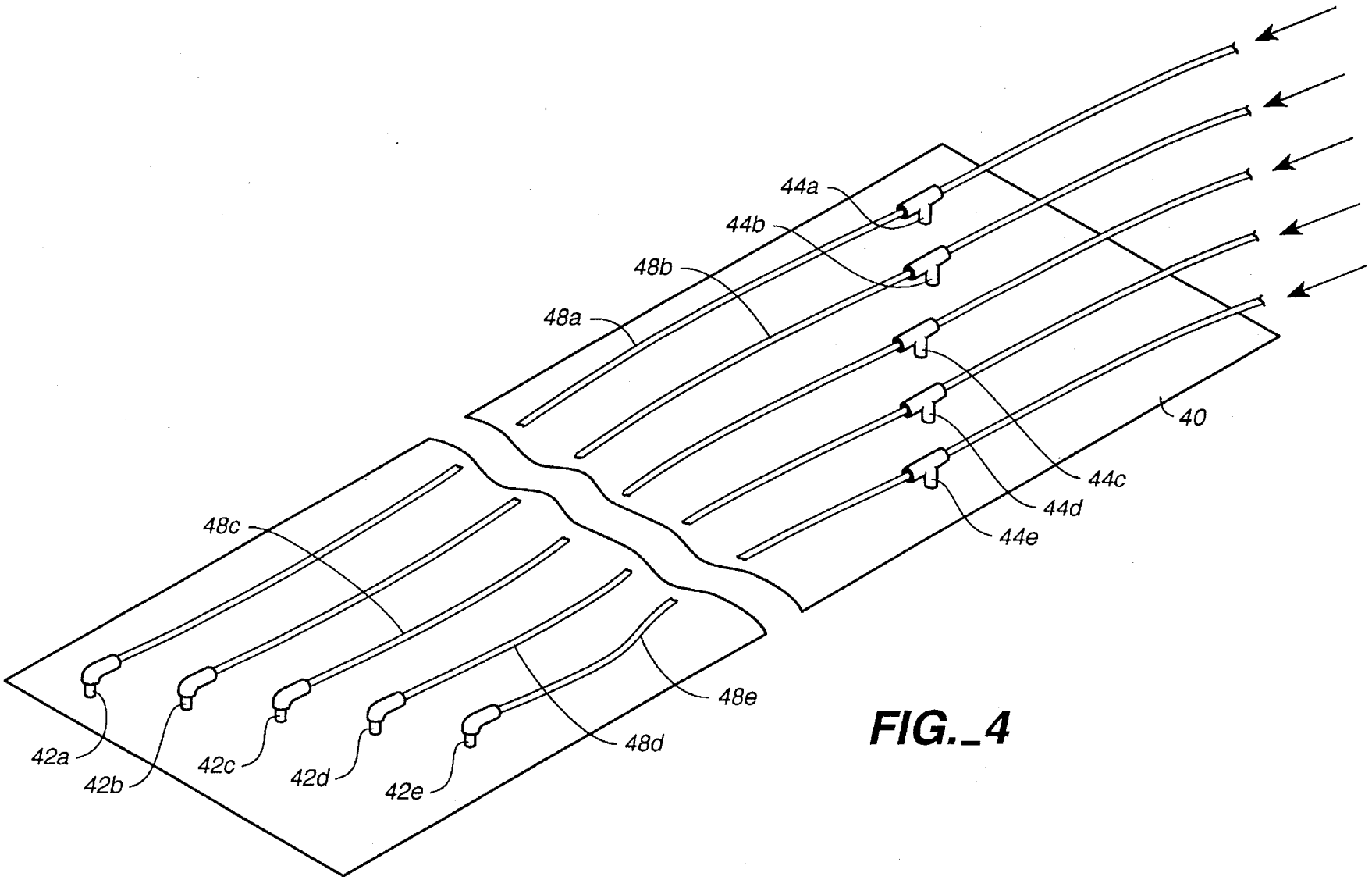
FIG. 4 is a perspective view showing details of the nozzle array and liquid delivery system of the apparatus.

Now also referring to FIGS. 2–4, the apparatus of the present invention includes a spray box 40 located above the lower run of the wire as shown diagrammatically in FIG. 1. The spray box is for the purpose of knocking off the trim from the wire into the couch pit 38.

FIG. 4 shows the bottom wall of the spray box 40 and FIG. 2 depicts the complete spray box which is supported by any suitable support means (not shown) above the forming wire 12. The spray box extends across the full width of the forming wire as shown in FIG. 2.

Positioned in the interior of the spray box 40 and for the purpose of spraying knock-off water onto the forming wire 12 are a plurality of knock-off shower nozzles 42*a*–42*e* and 44*a*–44*e*. These knock-off shower nozzles are located only at the ends of the spray box, as shown. The knock-off shower nozzles are spaced from one another and arrayed laterally relative to the path of movement of the forming wire and trim.

The liquid knock-off nozzles are for the purpose of directing a plurality of liquid knock-off sprays onto the paper web forming wire along marginal portions of the paper web forming wire adjacent to and inwardly of the edges of the forming wire. In FIG. 2, knock-off shower nozzles 42*a*, 42*b* and 44*a*, 44*b* are shown directing overlapping water sprays adjacent to both edges of the forming wire in the vicinity of trim strips 46, 48 which have been separated as described above from the main web by the air knife 30. The overlapping knock-off sprays will first engage the wire and then the trim strips to remove same from the wire.

As may perhaps best be seen with reference to FIG. 4, knock-off shower nozzles 42*a* and 44*a* are connected to a common supply line 48*a*. Likewise, nozzles 42*b* and 44*b* are connected to a supply line 48*b*. This same arrangement holds true with respect to the rest of the nozzles. That is to say, introduction of pressurized water into any of the supply lines will cause spray to be emitted from two knock-off shower nozzles operatively associated therewith, those two knock-off shower nozzles being equidistant from their respective associated wire edges.

Supply lines 48*a*–48*e* proceed from the spray box 40 to a header or manifold 50 which, in the present arrangement, is located within a control box 52. Of course, the control box 52 is preferably positioned where it can be readily accessed by the machine operator.

Each of the supply lines or liquid delivery lines has a solenoid operated valve associated therewith for controlling the flow of water through the line. Supply lines 48*b*, 48*c*, 48*d* and 48*e* are connected, respectively, to solenoid operated valves 52*b*, 52*c*, 52*d*, and 52*e*. These valves are located downstream from the interior of manifold or header 50 to either allow the flow of liquid from the manifold into lines 48*b* through 48*e* or terminate such flow.

A feed conduit 60 is connected to manifold 50 and delivers pressurized water thereto from a suitable supply source. A solenoid valve 62 is utilized to selectively terminate or initiate such flow. Since supply line 48*a* has no solenoid valve operatively associated therewith downstream from manifold 50 in the disclosed arrangement, opening of valve 62 will serve to pressurize the manifold interior and also cause the flow of pressurized water through supply line 48*a*. Of course, if desired, a separate solenoid valve similar to solenoid valves 52*b*–52*e* could be employed downstream from the manifold 50 with respect to supply line 48*a*.

As perhaps can best be seen with reference to FIG. 3, valves 62, 52*b*, 52*c*, 52*d*, and 52*e* are controlled respectively by on/off switches 66 labeled 1 through 5 in FIG. 3. That is, actuation of the switch designated by numeral 1 will actuate valve 62. Switches 2, 3, 4 and 5 will actuate, respectively, valves 52*b*, 52*c*, 52*d*, and 52*e*.

It can thus readily be seen that the flow of water through each knock-off shower nozzle can be readily selectively and independently controlled to vary the location of liquid knock-off sprays directed on to the marginal portions of the paper web forming wire and to vary the total quantity of liquid directed on to the marginal portions of the paper web forming wire by the knock-off shower nozzles. As shown in FIG. 2, signal light 70 is operatively associated with each of the switches 66 to display for the operator the identity of the open valves.

In the arrangement illustrated, the manifold 50 is also supplied by a second feed conduit 72 having a valve 74 associated therewith which may, for example, be utilized to direct white water through the nozzles.

We claim:

1. A paper web forming wire and knock-off showers combination comprising a paper web forming wire having two spaced edges and a forming wire support surface between said spaced edges for supporting a wet paper web during paper web formation;

paper slurry delivery means for delivering a paper slurry to the forming wire support surface of said paper web forming wire;

a plurality of knock-off shower nozzles located above and adjacent to said paper web forming wire, said knock-off shower nozzles being spaced from one another and arrayed laterally relative to the path of movement of the paper web forming wire for directing a plurality of liquid knock-off sprays directly on to said paper web forming wire along two spaced marginal portions of said paper web forming wire adjacent to and inwardly of the two spaced edges of said paper web forming wire;

liquid delivery means for delivering liquid to said plurality of knock-off shower nozzles; and control means operatively associated with said liquid delivery means and said plurality of knock-off shower nozzles for selectively and independently controlling the flow of liquid through said knock-off shower nozzles of said plurality of knock-off shower nozzles from said liquid delivery means to vary the location of liquid knock-off sprays directed on to the marginal portions of said paper web forming wire and to vary the total quantity of liquid directed onto the marginal portions of said paper web forming wire by said knock-off shower nozzles, said plurality of knock-off shower nozzles comprising two spaced groups of adjacent nozzles, with one of said groups located above each of the two spaced marginal portions of said paper web forming wire and the plurality of knock-off shower nozzles spaced to provide overlapping sprays along the two spaced marginal portions of said paper web forming wire when liquid exits from adjacent knock-off shower nozzles above the two spaced marginal portions of said upper web forming wire, said control means including a plurality of valves, each said valve being operatively associated with two of said knock-off shower nozzles, one of said two knock-off shower nozzles positioned above one of said margin portions of said paper web forming wire and the other of said two knock-off shower nozzles positioned above the other of said marginal portions of said paper web forming wire, said two knock-off shower nozzles being substantially equidistant from their respective paper web forming wire spaced edges, and each said valve of said plurality of valves operable to selectively simultaneously establish or terminate flow of liquid through its respective operatively associated two knock-off shower nozzles.

2. The combination according to claim 1 wherein said liquid delivery means includes a manifold defining a manifold interior and flow lines leading from said manifold to said plurality of knock-off shower nozzles.

3. The combination according to claim 1 wherein said valves are solenoid operated valves, said control means additionally comprising a plurality of actuators, each actuator of said plurality of actuators being operatively associated with one of said solenoid valves to actuate said solenoid valve to establish flow of liquid to the two knock-off shower nozzles respectively operatively associated with each of said solenoid valves.

4. The combination according to claim 3 wherein said actuators comprise manually actuated switches.

5. The combination according to claim 1 wherein said control means additionally comprises signal means operatively associated with each of said valves for indicating whether the associated valve is open to permit flow of liquid through said two knock-off shower nozzles or closed to terminate flow of liquid through said two knock-off shower nozzles.

* * * * *